US010151155B2

(12) United States Patent
Jones et al.

(10) Patent No.: US 10,151,155 B2
(45) Date of Patent: Dec. 11, 2018

(54) MODULAR CAROUSEL FOR A DRILLING RIG

(71) Applicant: Caterpillar Inc., Peoria, IL (US)

(72) Inventors: Rahman Jones, McKinney, TX (US); Steven Precopia, Van Alstyne, TX (US); Michael Santopietro, Anna, TX (US)

(73) Assignee: Caterpillar Inc., Deerfield, IL (US)

( * ) Notice: Subject to any disclaimer, the term of this patent is extended or adjusted under 35 U.S.C. 154(b) by 308 days.

(21) Appl. No.: 15/007,287

(22) Filed: Jan. 27, 2016

(65) Prior Publication Data

US 2017/0211342 A1 Jul. 27, 2017

(51) Int. Cl.
*E21B 19/14* (2006.01)

(52) U.S. Cl.
CPC ..... *E21B 19/146* (2013.01)

(58) Field of Classification Search
CPC ..... E21B 19/146
See application file for complete search history.

(56) References Cited

U.S. PATENT DOCUMENTS 3,301,191 A * 1/1967 Warren ..... F16J 15/38 277/366
4,445,579 A 5/1984 Bello
4,897,009 A * 1/1990 Powell ..... E21B 19/146 175/52
5,284,375 A * 2/1994 Land, III ..... E21B 19/14 294/115
5,688,067 A * 11/1997 Straub ..... E21B 43/121 403/300
5,762,150 A * 6/1998 Cheng ..... E21B 19/14 175/52
7,665,685 B2 2/2010 Moore, III et al.
2009/0255728 A1 10/2009 Spencer et al.
2010/0200297 A1 8/2010 Comacchio et al.
2014/0338973 A1 11/2014 Taylor et al.
2015/0069759 A1 3/2015 Aranovich et al.

FOREIGN PATENT DOCUMENTS

RU 2422672 C2 9/2009

* cited by examiner

*Primary Examiner* — David J Bagnell
*Assistant Examiner* — Brandon M Duck
(74) *Attorney, Agent, or Firm* — Miller, Matthias & Hull

(57) ABSTRACT

A modular carousel for holding a drill pipe segment in a drilling rig includes a central support having a top end and a bottom end, and a top plate removably coupled to the top end of the central support, the top plate including a top plate slot sized to receive an upper end portion of the drill pipe segment. A breaker plate has a breaker plate slot sized to receive an intermediate portion of the drill pipe segment, and a coupler assembly is configured to removably attach the breaker plate to the bottom end of the central support. A base plate is coupled to the breaker plate by an extension support, the base plate including a cup sized to receive a bottom end portion of the drill pipe segment.

20 Claims, 11 Drawing Sheets

MODULAR CAROUSEL FOR A DRILLING RIG

TECHNICAL FIELD

The present disclosure generally relates to drilling rigs, and more particularly to carousels provided on drilling rigs for adding and removing drill pipe segments.

BACKGROUND

This section is intended to provide a background or context to the invention recited in the claims. The description herein may include concepts that could be pursued, but are not necessarily ones that have been previously conceived or pursued. Therefore, unless otherwise indicated herein, what is described in this section is not prior art to the description and claims in this application and is not admitted to be prior art by inclusion in this section.

Drilling systems are generally known to include a vertical drill tower (e.g. mast, etc.) constructed from structural members such as steel beams and reinforcing supports. The drill tower is often coupled to a mobile platform (e.g. which along with other components typically form a drilling rig) for positioning the drill tower in a desired location to conduct a drilling operation. The drill tower is often equipped with a drill carousel which is structured and adapted to support a drill string formed from a combination of pipe segments (e.g., drill pipes, drill rods, drill extenders, etc.). The drill carousel is used to selectively add the pipe segments to the drill string for drilling a hole having a desired depth. The drill carousel is intended to allow a drilling operation to progress into the drill hole by making readily available a continuous string of pipe segments as needed for advancing a drilling tool into a drill hole.

Throughout the drilling operation, it is often desirable or necessary to add or remove a pipe segment from the drill string in order to meet a desired drilling depth, such as a depth that is greater or deeper than the depth restricted by the length of the drill tower. To minimize downtime in the drilling operation due to adding or removing a pipe segment, systems and mechanisms may be provided to facilitate moving the drill carousel to a change-out position and adding or removing pipe segments from the drill string.

One example of such a mechanism can be found in U.S. Pat. Application Publication No. 2014/0338973, published on Nov. 20, 2014, for "Automatic Drill Pipe Add and Remove System," which discloses a system having actuators for moving and rotating a carousel and sensors for detecting positions of components provided on the carousel. A control module is provided to automatically control the actuators based on feedback from the sensors, thereby automatically adding or removing drill pipe segments without necessitating operator involvement. While this system makes it significantly easier and faster to add or remove pipe segments having the same diameter and length, it is not easily reconfigured to handle pipe segments having different diameters and/or lengths. Instead, the carousel components are typically welded together, and therefore the carousel must either be replaced or requires significant work (such as cutting welds) to adapt it for the new pipe segment diameter and/or length.

SUMMARY OF THE DISCLOSURE

In accordance with one aspect of the present disclosure, a modular carousel for holding a drill pipe segment is provided for a drilling rig. The modular carousel includes a central support having a top end and a bottom end, and a top plate removably coupled to the top end of the central support, the top plate including a top plate slot sized to receive an upper end portion of the drill pipe segment. A breaker plate has a breaker plate slot sized to receive an intermediate portion of the drill pipe segment, and a coupler assembly is configured to removably attach the breaker plate to the bottom end of the central support. A base plate is coupled to the breaker plate by an extension support, the base plate including a cup sized to receive a bottom end portion of the drill pipe segment.

In accordance with another aspect of the present disclosure, a modular carousel kit is provided for use with a drilling rig. The modular carousel kit includes a central support having a top end and a bottom end, and a central support flange coupled to the bottom end of the central support. The kit further includes a first carousel assembly for holding a first drill pipe segment having a first diameter, the first carousel assembly including a first top plate configured for removable coupling to the top end of the central support, the first top plate including a first top plate slot sized to receive an upper end portion of the first drill pipe segment, a first breaker plate configured for removable coupling to the central support flange, the first breaker plate having a first breaker plate slot sized to receive an intermediate portion of the first drill pipe segment, and a first base plate coupled to the first breaker plate by a first extension support, the first base plate including a first cup sized to receive a bottom end portion of the first drill pipe segment. Still further, the kit includes a second carousel assembly for holding a second drill pipe segment having a second diameter different than the first diameter of the first pipe segment, the second carousel assembly including a second top plate configured for removable coupling to the top end of the central support, the second top plate including a second top plate slot sized to receive an upper end portion of the second drill pipe segment, a second breaker plate configured for removable coupling to the central support flange, the second breaker plate having a second breaker plate slot sized to receive an intermediate portion of the second drill pipe segment, and a second base plate coupled to the first breaker plate by a second extension support, the second base plate including a second cup sized to receive a bottom end portion of the second drill pipe segment.

In accordance with another aspect of the present disclosure, a method is provided of reconfiguring a carousel for a drilling rig from a first configuration sized to hold a first drill pipe segment having a first diameter to a second configuration sized to hold a second drill pipe segment having a second diameter different from the first diameter. The method includes supporting a central support of the carousel independent of the drilling rig, removing a first top plate from a top end of the central support, the first top plate including a first top plate slot sized to receive an upper end portion of the first drill pipe segment, removing a first breaker plate from a bottom end of the central support by disassembling a first coupler assembly, the first breaker plate including a first breaker plate slot sized to receive an intermediate portion of the first drill pipe segment, and removing a first base plate and first extension support from a bottom end of the central support, the first base plate including a first cup sized to receive a bottom end portion of the first drill pipe segment. The method further includes attaching a second top plate to a top end of the central support, the second top plate including a second top plate slot sized to receive an upper end portion of the second drill pipe segment, attaching a second breaker plate to the bottom end of the central support by assembling a second coupler assembly, the second breaker plate including a second breaker plate slot sized to receive an intermediate portion of the second drill pipe segment, and attaching a second base plate and second extension support to a bottom end of the central support, the second base plate including a second cup sized to receive a bottom end portion of the second drill pipe segment.

It should be understood that the drawings are not necessarily to scale and that the disclosed embodiments are sometimes illustrated diagrammatically and in partial views. In certain instances, details which are not necessary for an understanding of the disclosed methods and apparatuses or which render other details difficult to perceive may have been omitted. It should be understood, of course, that this disclosure is not limited to the particular embodiments illustrated herein.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Referring to the Figures, a modular drill pipe carousel for a rotary drilling machine such as a drilling rig 10 (or other suitable mobile or stationary drilling system) is shown according to an exemplary embodiment for use in mining, excavation, wells, blast hole drilling or other drilling or boring operations. Although the modular drill pipe carousel is shown and described by way of example as being used with a mobile drilling rig 10, the carousel of the present disclosure is suitable for use with any of a wide variety of other mobile or stationary drilling systems, all of which are intended to be within the scope of this disclosure.

Figure 1:
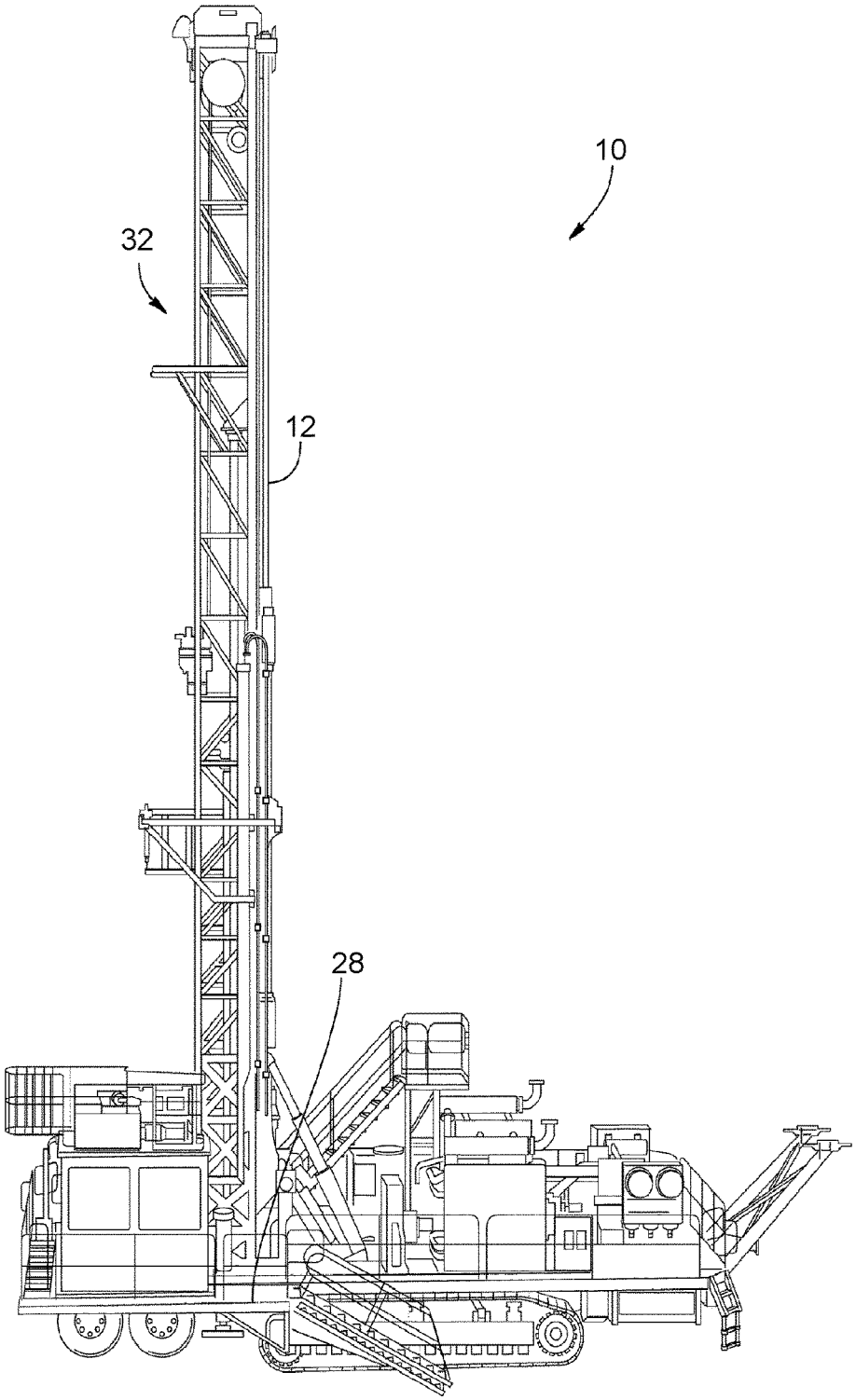
FIG. 1 is a schematic image of a drilling rig of the present disclosure, according to an exemplary embodiment.
Figure 2:
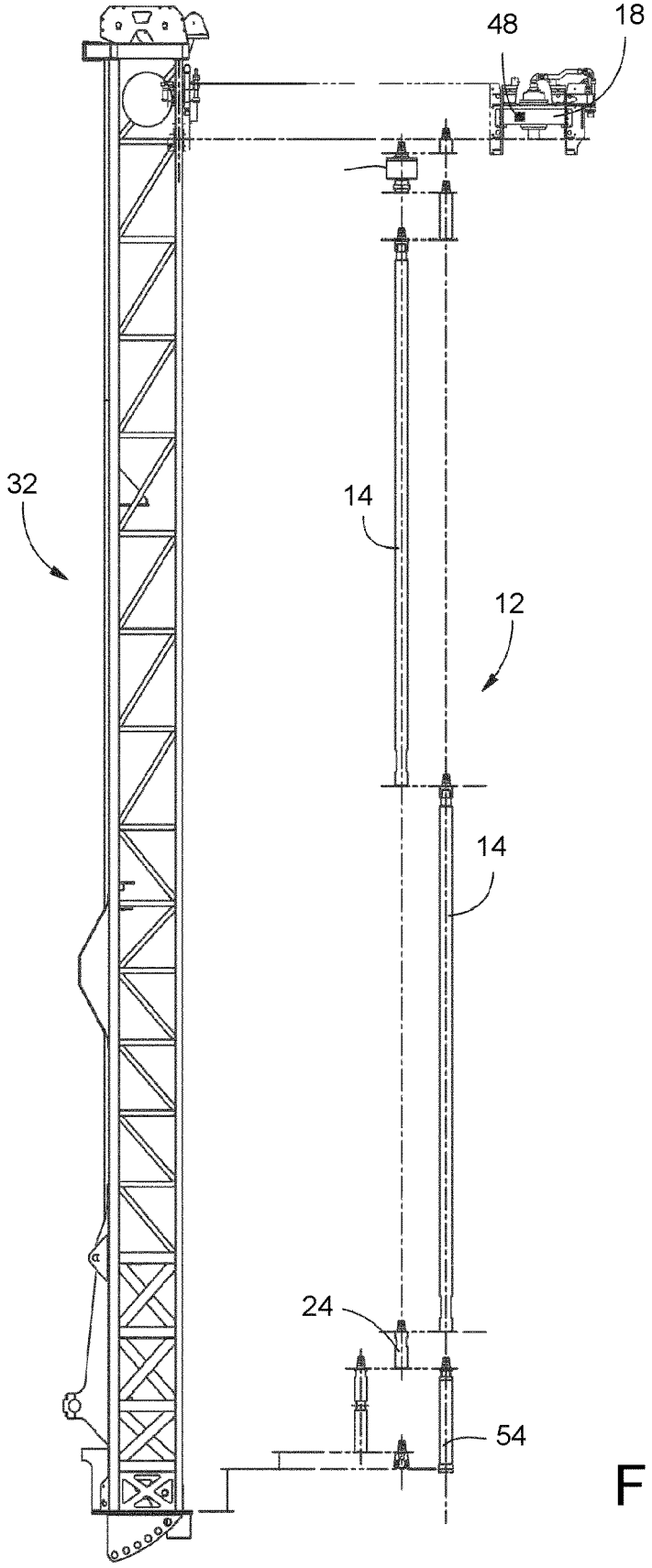
FIG. 2 is an exploded schematic image of components of the drilling rig of FIG. 1, including a drill tower, drill rods and drilling tools, according to an exemplary embodiment.

Referring to FIGS. 1 and 2, a drilling rig 10 having a modular drill pipe carousel is shown, according to an exemplary embodiment. The modular drill pipe carousel to be further described herein is intended to permit certain components of the carousel to be removed and replaced, thereby to adapt the carousel for different lengths and/or diameters of drill pipes or extenders (shown in FIG. 2 as pipe segments 14) used in a drill string 12 of the drilling rig 10. In an exemplary embodiment, the modular drill pipe carousel may include a lower sub-assembly having a breaker plate integrally provided with a bottom plate that may be attached to and removed from a central support tube as a unit, thereby allowing the carousel to be quickly and easily adjusted for a different drill pip length and/or diameter.

The drilling rig 10 includes a drill string 12 coupled to a drill tower 32. The drill string 12 includes one or more pipe segments 14 (i.e., drill pipe segments) for extending the length of the drill string 12 in order to meet the desired drilling depth. The pipe segments 14 may be coupled on a first end to a drill head 18 and on a second end to a drill tool 54 (e.g., hammer, etc.) by one or more adapters, such as adapters 20 and 24 shown in FIG. 3. The drill string 12 is configured to apply a downward force (according to FIGS. 1 and 2) to a drilling surface, driving the drill tool 54 into the drilling surface in response to instructions received from a control device (e.g., control module, operator interface, etc.).

Figure 3:
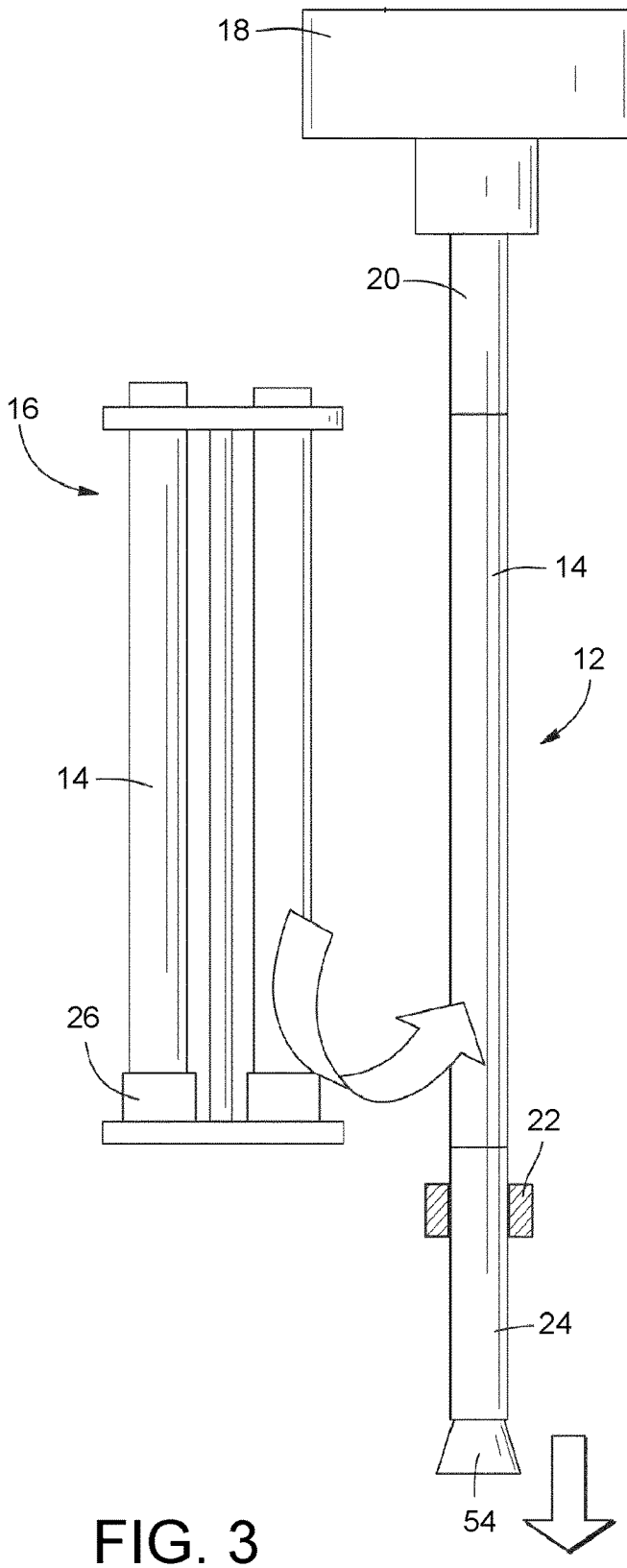
FIG. 3 is a schematic image of a drill string and a drill pipe carousel, according to an exemplary embodiment.

Referring now to FIG. 3, a schematic for the drill string 12 is shown, according to an exemplary embodiment. In this embodiment, the drill string 12 includes a single pipe segment 14 for extending the length of the drill string 12. The top adapter 20 and the bottom adapter 24 couple the pipe segment 14 to the other components of the drill string 12. In some embodiments, the adapters 20 and 24 and pipe segment 14 include corresponding threads configured to mate with each other (i.e., the pipe segment 14 to the adapters 20 and 24), removably coupling the adapters 20 and 24 to the pipe segment 14. In these embodiments, for instance, the pipe segment 14 may be joined with the adapter 20 by "screwing" the pipe segment 14 into the adapter 20 (i.e., rotating the pipe segment 14 in a clockwise direction such that the corresponding threads of the pipe segment 14 and the adapter 20 are mated). In an exemplary embodiment, each component of the drill string 12 includes corresponding threads configured to mate with each other by screwing a first component into a second component. In the illustrated embodiment of FIG. 3, drill head 18 is coupled to the top adapter 20 and drill tool 54 is coupled to the bottom adapter 24. The drill head 18 may be configured to rotate in a clockwise direction in order to add (i.e., screw on) a pipe segment 14 or a counter-clockwise direction in order to remove (i.e., unscrew) a pipe segment 14. The drill tool 54 may be positioned at the bottom of the drill string 12 in order to drill a surface. The drill string 12 may also include a deck wrench 22 for clamping onto the bottom adapter 24. The deck wrench 22 is configured to hold the bottom adapter 24 stationary so that the pipe segment 14 may be connected to or removed from the bottom adapter 24 (i.e., by rotating the pipe segment 14 relative to the bottom adapter 24).

Figure 6:
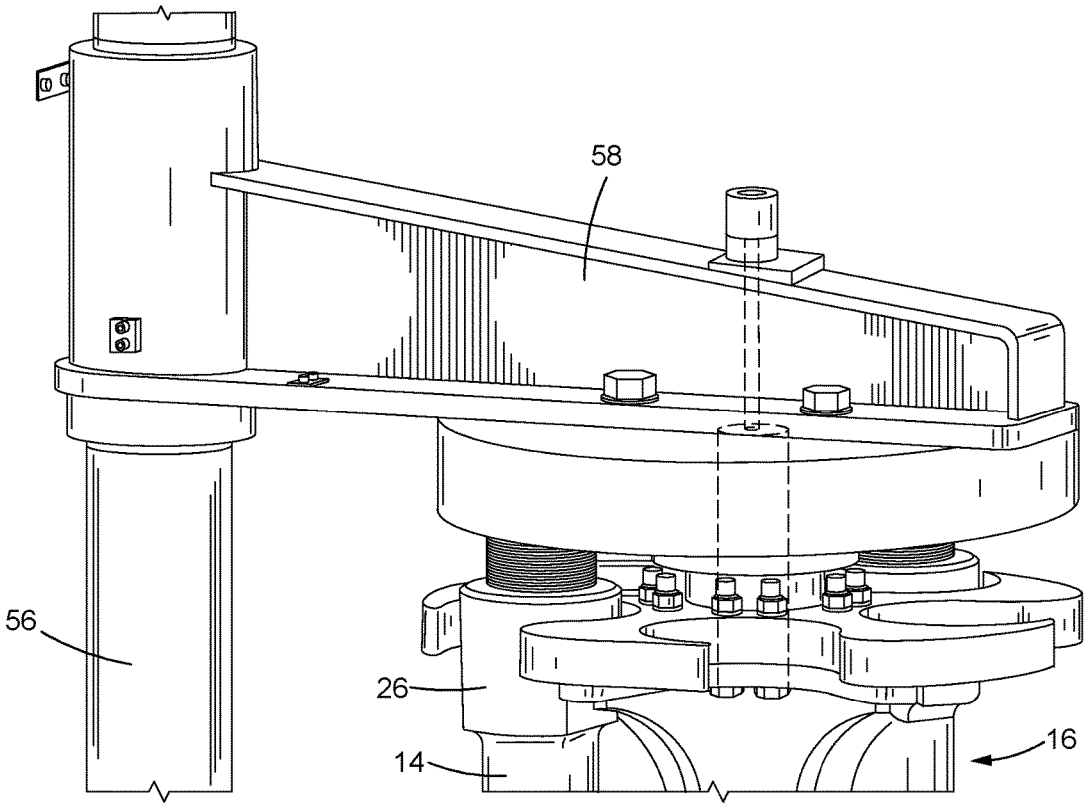
FIG. 6 is a perspective view of the top of a drill pipe carousel, according to an exemplary embodiment.

Still referring to FIG. 3, a drill pipe carousel 16 is schematically illustrated, according to an exemplary embodiment. The drill pipe carousel 16 (i.e. drill pipe storage rack, drilling rig carousel, etc.) may be structured and adapted to support one or more drill components, such as pipe segments 14 or drill tools 54. The drill pipe carousel 16 may be used to selectively add pipe segments 14 and/or drill tools 54 to the drill string 12. The drill pipe carousel 16 is configured to "swing" or pivotally move between an add/remove position (i.e., in axial alignment with the drill string 12) for adding or removing pipe segments 14 to or from the drill string 12, and a stowed position (i.e., adjacent the drill string 12 during the drilling operation). In an exemplary embodiment, a carousel arm 58 (shown in FIG. 6) pivots the drill pipe carousel 16 about a pivot point shown as post 56 (shown in FIG. 6) in order to swing the drill pipe carousel 16 between the add/remove position and the stowed position. In this embodiment, the carousel arm 58 and the drill pipe carousel 16 may be controlled by a control device such as control module.

The drill pipe carousel 16 includes a plurality of receptacles 26 configured to hold drill components (e.g., pipe segments 14, drill tools 54, etc.). One or more of the receptacles 26 may be empty at any time for receiving pipe segments 14 or other drill components that are removed from the drill string 12.

From the add/remove position, the drill pipe carousel 16 is configured to "index" (i.e., rotate about its central axis) in a clockwise or counter-clockwise direction. While the swing motion pivots the drill pipe carousel 16 away from and toward the drill string 12, this indexing motion rotates the drill pipe carousel 16 around its center axis, with the center axis remaining stationary relative to the drill string 12. As the drill pipe carousel 16 is indexed, the receptacles 26 are rotated through a loading position (i.e., a position in line with the drill string 12 for removing or adding a pipe segment 14) for interacting with the drill string 12. In an exemplary embodiment, the drill pipe carousel 16 is indexed so that an empty receptacle 26 is moved to the loading position in order to remove a pipe segment 14 from the drill string 12, and the drill pipe carousel 16 is indexed so that a receptacle 26 holding a pipe segment 14 is moved to the loading position in order to add a pipe segment 14 to the drill string 12.

In the add/remove position, the drill pipe carousel 16 is positioned substantially within the drill tower 32 (i.e., in axial alignment with the drill string 12), such that pipe segments 14 may be removed from the drill pipe carousel 16 and connected to the drill string 12, or removed from the drill string 12 and stored within an empty receptacle 26 of the drill pipe carousel 16. In the stowed position, the drill pipe carousel 16 is positioned adjacent to the drill string 12 as not to interfere with the drilling operation.

Figure 4:
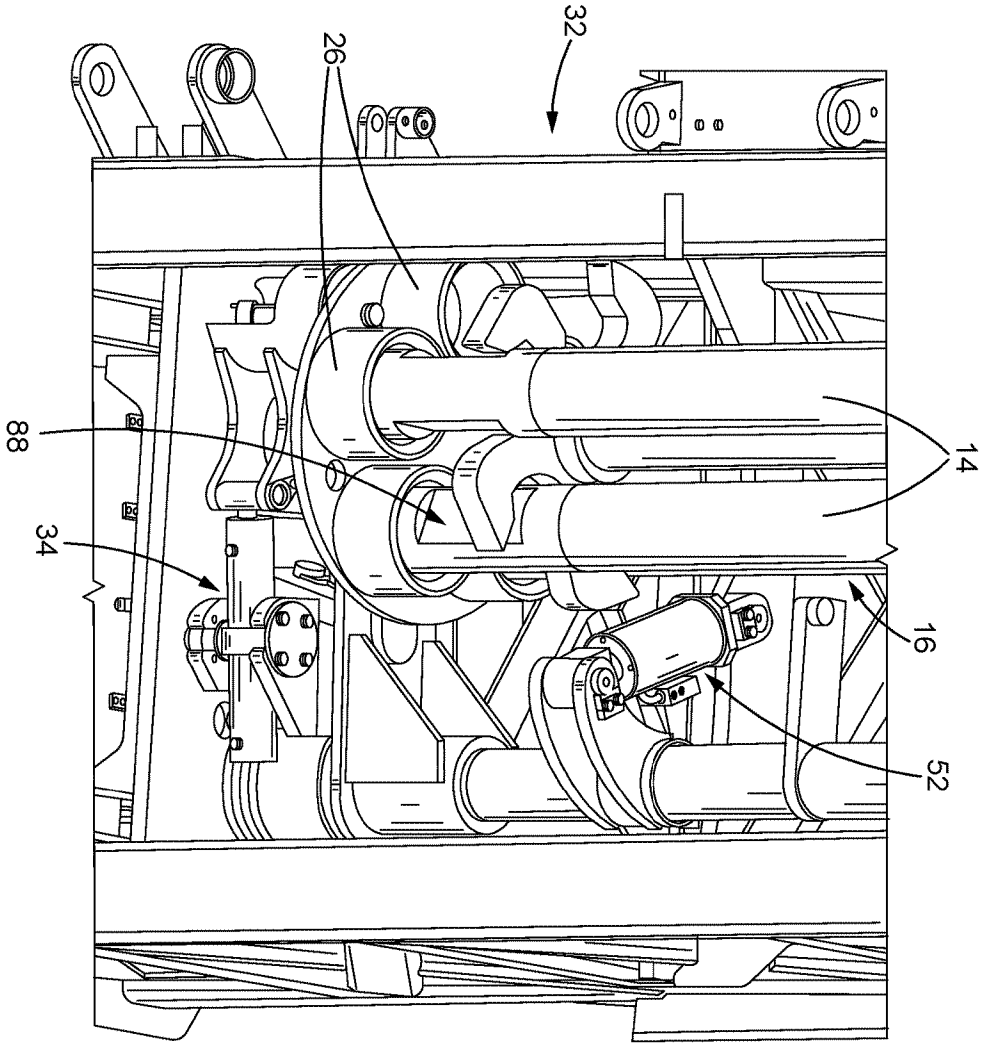
FIG. 4 is a perspective view of a portion of the drill tower of FIG. 2, according to an exemplary embodiment.

In an exemplary embodiment, the drilling rig 10 includes an actuator configured to move or swing the drill pipe carousel 16 between a first position and a second position, which is shown as hydraulic cylinder 52 in the illustrated embodiment of FIG. 4. In other embodiments, the actuator may be another actuating device (e.g., motor, etc.) suitable for moving or swinging the drill pipe carousel 16 as necessary. In an exemplary embodiment, the hydraulic cylinder 52 controls the swing movement of the drill pipe carousel 16, extending to swing (i.e., pivotally push) the drill pipe carousel 16 to the add/remove position, and retracting to swing (i.e., pivotally pull) the drill pipe carousel 16 to the stowed position. In other embodiments, the hydraulic cylinder 52 and drill pipe carousel 16 may be configured such that the hydraulic cylinder 52 retracts to swing the drill pipe carousel 16 to the add/remove position and extends to swing the drill pipe carousel 16 to the stowed position.

Figure 5:
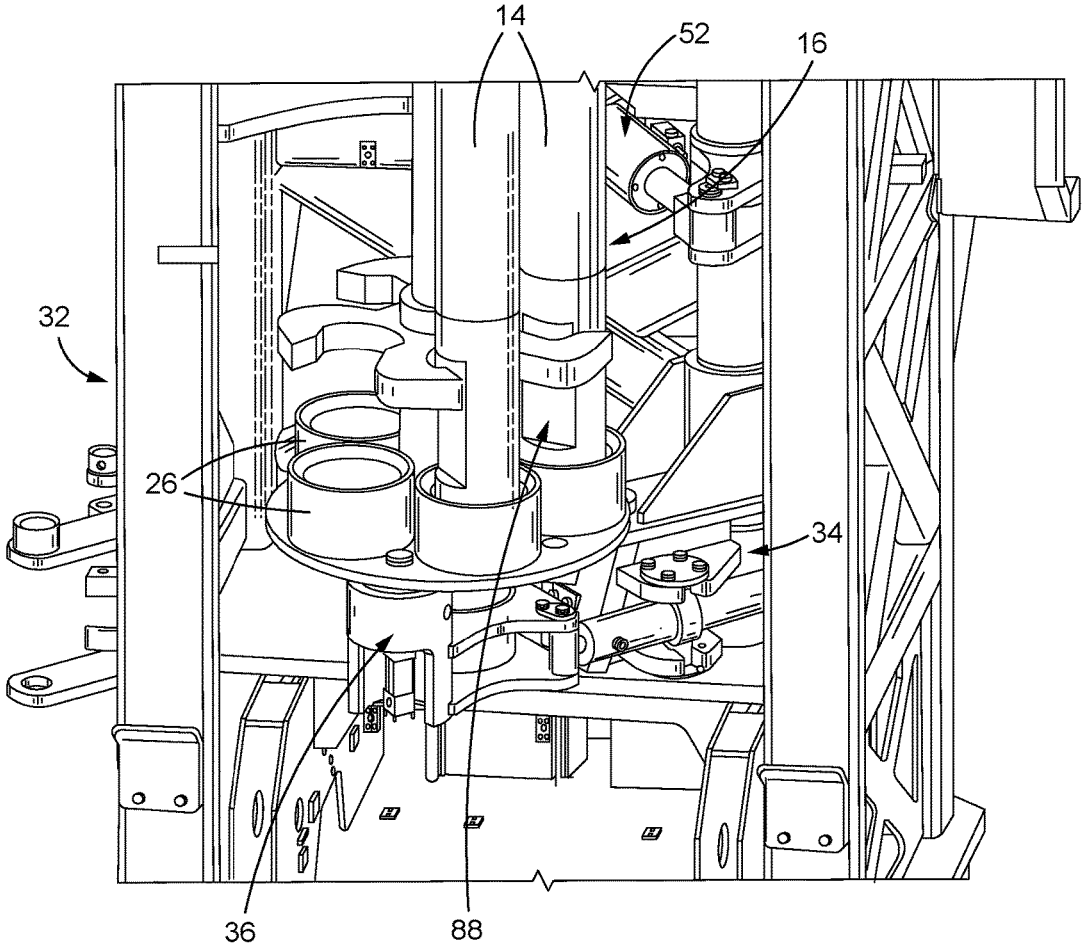
FIG. 5 is perspective view of another portion of the drill tower of FIG. 2, according to an exemplary embodiment.

Referring further to FIG. 5, the drill pipe carousel 16 is shown in the add/remove position. In this position, the drill pipe carousel 16 is configured to rotationally index about its center axis in a clockwise or counter-clockwise direction, rotating a pipe segment 14, drill tool 54, or an empty receptacle 26 to the loading position. In the illustrated embodiment of FIG. 5, the drill pipe carousel 16 includes an actuator configured to control the axial rotation of the drill pipe carousel 16 and shown as hydraulic cylinder 34. In other embodiments, the actuator may be another actuating device suitable for axially rotating the drill pipe carousel 16, such as a motor. The hydraulic cylinder 34 may be coupled to the drill pipe carousel 16 in order to axially rotate the drill pipe carousel 16. In some embodiments, the hydraulic cylinder 34 is removably coupled to the drill pipe carousel 16. In these embodiments, a locking device 36 (i.e., cylinder lock, lock) may be positioned on the bottom of the drill pipe carousel 16 and configured to mate with a portion of the hydraulic cylinder 34. The locking device 36 of FIG. 5 has a locked position for clamping the hydraulic cylinder 34, thereby coupling the hydraulic cylinder 34 to the drill pipe carousel 16. The locking device 36 also has an unlocked position for de-coupling the hydraulic cylinder 34 from the drill pipe carousel 16, allowing the hydraulic cylinder 34 to move independent of the drill pipe carousel 16.

When the locking device 36 is in the locked position, the drill pipe carousel 16 rotates axially in relation to the movement of the hydraulic cylinder 34. According to the illustrated embodiment of FIG. 5, the drill pipe carousel 16 is indexed in a clockwise direction as the hydraulic cylinder 34 is moved from a retracted position to an extended position. For instance, the drill pipe carousel 16 and hydraulic cylinder 34 may be configured such that an adjacent receptacle 26 (i.e., adjacent to the loading position) is rotated clockwise to the loading position in response to the hydraulic cylinder 34 moving from a substantially retracted position to a substantially extended position.

In order to rotate the drill pipe carousel 16 in a counter-clockwise direction, the locking device 36 is moved to the unlocked position, de-coupling the hydraulic cylinder 34 from the drill pipe carousel 16. The hydraulic cylinder 34 may then be moved to the substantially extended position without rotating the drill pipe carousel 16. Once the hydraulic cylinder 34 is in the substantially extended position, the locking device 36 may be moved to the locked position, re-coupling the hydraulic cylinder 34 to the drill pipe carousel 16. In this configuration, as the hydraulic cylinder 34 is moved from the substantially extended position to the substantially retracted position, the coupled drill pipe carousel 16 is rotated in the counter-clockwise direction. In an exemplary embodiment and in this configuration, an adjacent receptacle 26 is moved counter-clockwise to the loading position when the hydraulic cylinder 34 is moved from the substantially extended position to the substantially retracted position.

An embodiment of a modular carousel 60 is shown in greater detail in FIGS. 7-10. The modular carousel 60 includes a central support 62 having a top end 64 and a bottom end 66. In the exemplary embodiment, the central support 62 has an upper support segment 68 defining the top end 64, a lower support segment 70 defining the bottom end 66, and a joint 72 configured to removably attach the upper support segment 68 to the lower support segment 70.

Figure 7:
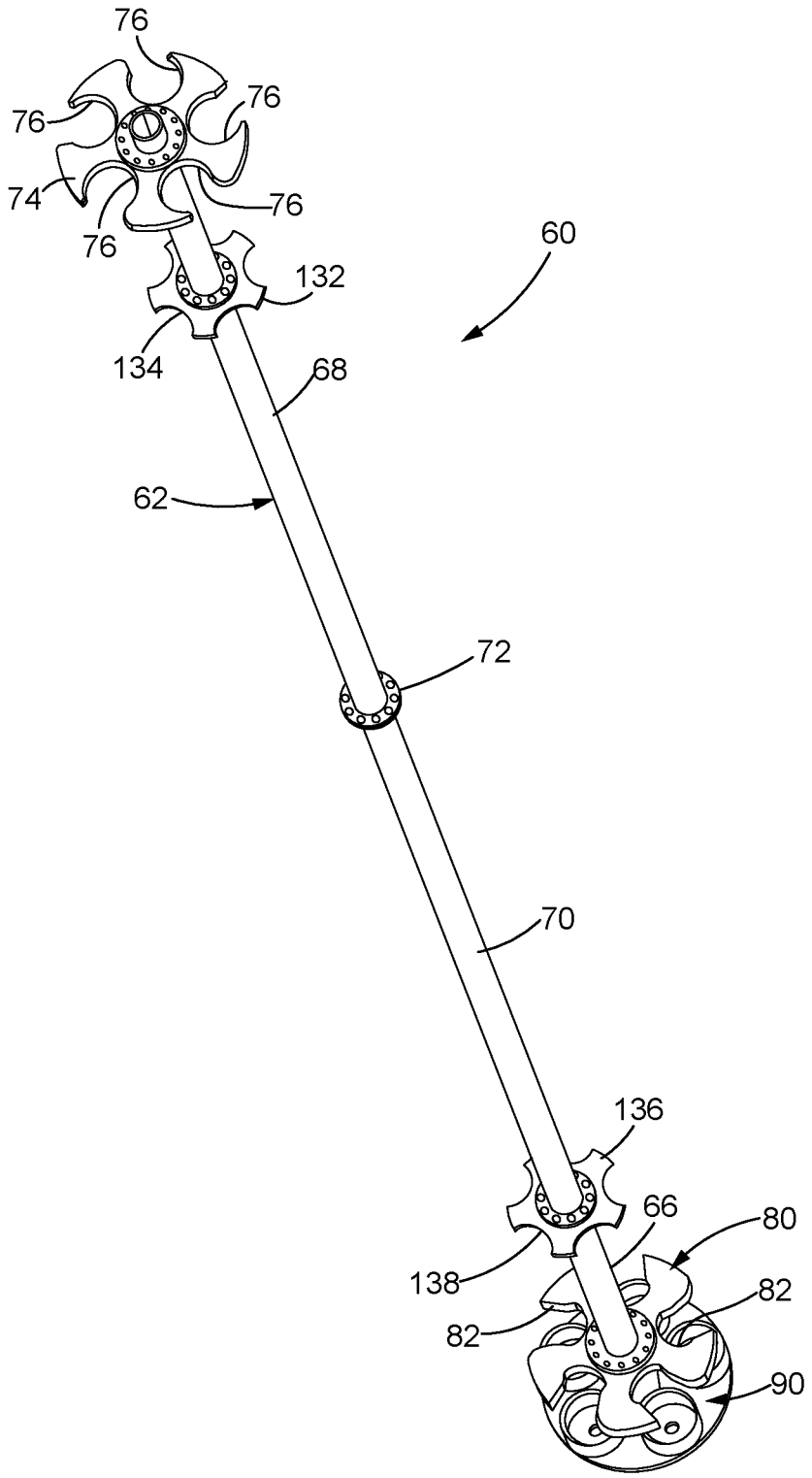
FIG. 7 is a perspective view of an assembled drill pipe carousel, according to an exemplary embodiment.

A top plate 74 is removably coupled to the top end 64 of the central support 62 to support upper ends of the drill pipe segments 14. As best shown in FIG. 7, the top plate 74 includes a plurality of top plate slots 76 sized to receive upper end portions of the drill pipe segments 14. While the illustrated embodiment includes five top plate slots 76, it will be appreciated that the number of top plate slots 76 may be less than or greater than five without departing from the present disclosure.

Figure 8:
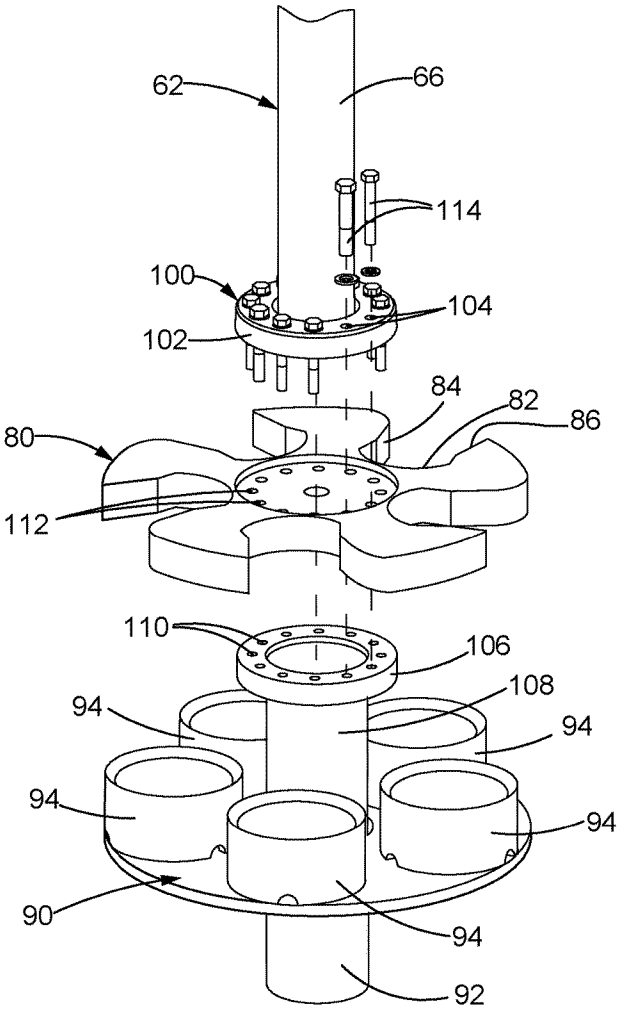
FIG. 8 is an enlarged exploded view of a lower end of the drill pipe carousel of FIG. 7.
Figure 10:
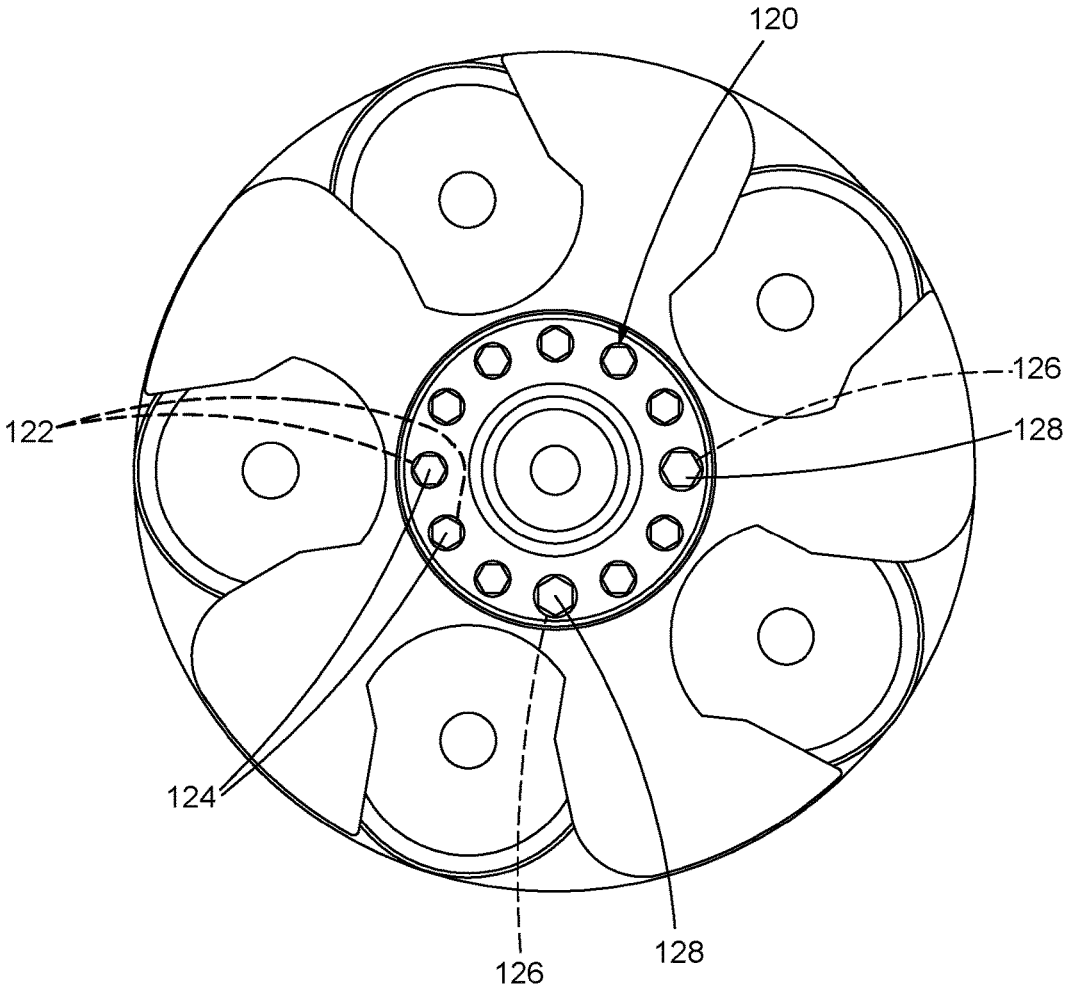
FIG. 10 is a plan view of the lower end of the drill pipe carousel take along line 10-10 of FIG. 9.

A breaker plate 80 is removably coupled to the bottom end 66 of the central support 62 to support intermediate portions of the drill pipe segments 14. As best shown in FIGS. 7, 8, and 10, the breaker plate 80 includes a plurality of breaker plate slots 82 sized to receive intermediate portions of the drill pipe segments 14. Each breaker plate slot 82 may include diametrically opposed flats 84, 86 sized to engage complementary shaped flat sections 88 of the drill pipe segments (FIGS. 4 and 5). While the illustrated embodiment includes five breaker plate slots 82, fewer than or more than five breaker plate slots 82 may be used without departing from the present disclosure.

Figure 9:
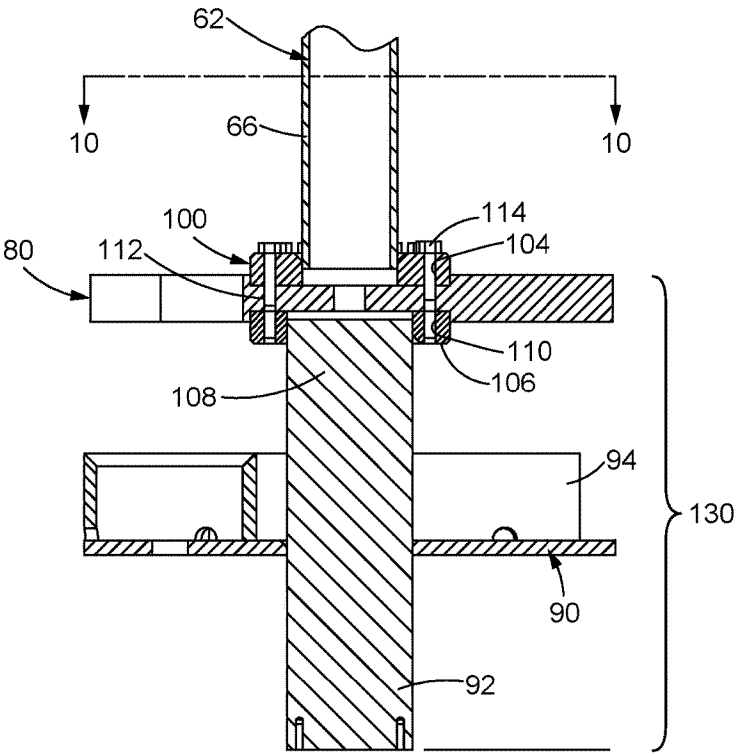
FIG. 9 is a side elevation view, in cross-section, of the lower end of the drill pipe carousel of FIG. 7.

A base plate 90 is removably coupled to the bottom end 66 of the central support 62 to support lower ends of the drill pipe segments 14. As best shown in FIGS. 8 and 9, the base plate 90 is attached to an extension support 92, which in turn is coupled to the bottom end 66 of the central support 62. The base plate includes a plurality of cups 94 sized to receive bottom end portions of the drill pipe segments 14.

A coupler assembly 100 is provided to permit the breaker plate 80, base plate 90, and extension support 92 to be removably attached to the central support 62. As best shown in FIGS. 8-10, the coupler assembly 100 comprises a central support flange 102 coupled to the bottom end 66 of the central support 62 and defining a first set of bolt holes 104. An extension support flange 106 is coupled to an upper end 108 of the extension support 92 and defines a second set of bolt holes 110. The coupler assembly 100 further includes a third set of bolt holes 112 formed through the breaker plate 80, and a plurality of fasteners 114. The first, second, and third sets of bolt holes 104, 110, 112 may be aligned as shown in FIG. 8 so that the fasteners 114 may be inserted therethrough to secure the breaker plate 80 between the central support flange 102 and the extension support flange 106. More specifically, each of the first, second, and third sets of bolt holes 104, 110, 112 has an identical bolt hole pattern 120 to facilitate assembly of the breaker plate 80, base plate 90, and extension support 92 onto the central support 62. In some embodiments, the bolt hole pattern 120 may be configured so that assembly is possible only when each of the central support flange 102, extension support flange 106, and breaker plate 80 are in specific rotational positions relative to each other.

For example, as best shown in FIG. 10, the bolt hole pattern 120 includes a plurality of regular size bolt holes 122 for receiving regular size fasteners 124 and two oversized bolt holes 126 having larger diameters for receiving larger fasteners 128. The oversized bolt holes 126 are both provided on the same halves of the central support flange 102, extension support flange 106, and breaker plate 80 so that assembly is permitted only when each of the central support flange 102, extension support flange 106, and breaker plate 80 is in a particular rotational position relative to the others. When each of the first, second, and third sets of bolt holes 104, 110, 112, are respectively configured such that they have the same angular relation to the top plate slots 76, cups 94, and breaker plate slots 82, assembly of the coupler assembly 100 automatically ensure that the top plate slots 76, cups 94, and breaker plate slots 82 are axially aligned.

In some embodiments, the breaker plate 80, base plate 90, and extension support 92 may be integrally provided as a unitary base end sub-assembly 130. As a result, the base end sub-assembly 130 may be attached to or removed from the bottom end 66 of the central support 62 as a unit, thereby facilitating assembly and disassembly of the modular carousel 60.

The modular carousel 60 may further include guides for further securing drill pipe segments 14 in the desired locations. As best shown in FIG. 7, for example, the modular carousel 60 may include an upper guide 132 removably coupled to the central support 62 and defining upper guide slots 134, and a lower guide 136 removably coupled to the central support 62 and defining lower guide slots 138.

Figure 11:
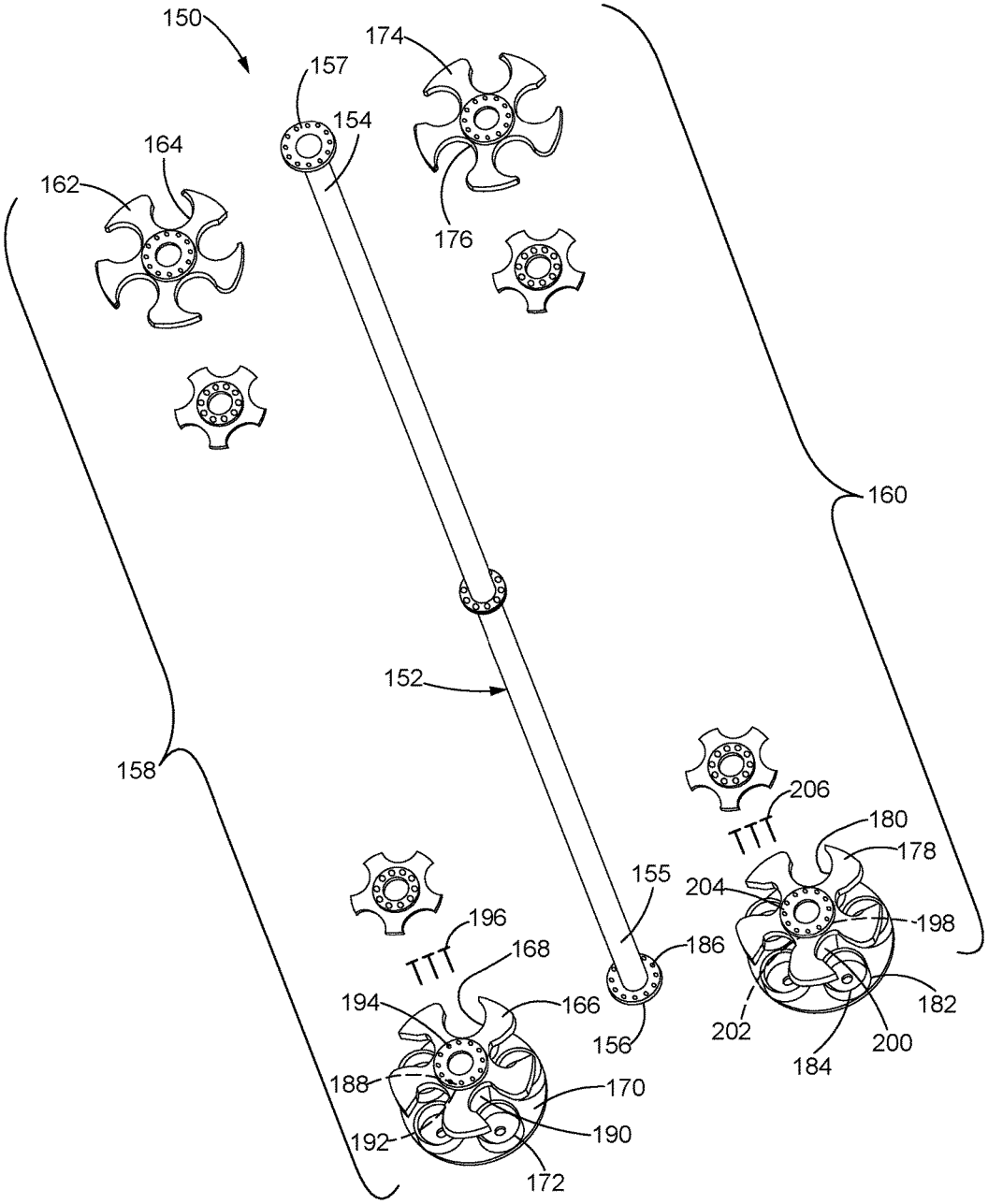
FIG. 11 is a perspective view of a modular carousel kit, according to an exemplary embodiment.

In some embodiments, a modular carousel kit 150 may be provided to facilitate quick and easy reconfiguration of the carousel for drill pipe segments having different diameters and/or lengths. As best shown in FIG. 11, for example the modular carousel kit 150 includes a central support 152 having a top end 154 and a bottom end 155. A central support flange 156 is coupled to the bottom end 155 of the central support 152, while an upper flange 157 is coupled to the top end 154 of the central support 152.

First and second carousel assemblies 158, 160 may be provided that are each independently attachable to the central support 152. Each of the first and second carousel assemblies 158, 160 may include components similar to those described in the above embodiments, but configured to hold a drilling pipe segment having a particular diameter and/or length. Accordingly, the first carousel assembly 158 may have a first top plate 162 with first top plate slots 164, first breaker plate 166 with first breaker plate slots 168, and a first base plate 170 carrying first cups 172, wherein the first top plate slots 164, first breaker plate slots 168, and first cups 172 are sized to receive portions of first drill pipe segments having a first diameter. Similarly, the second carousel assembly 160 may have a second top plate 174 with second top plate slots 176, a second breaker plate 178 with second breaker plate slots 180, and a second base plate 182 carrying second cups 184, wherein the second top plate slots 176, second breaker plate slots 180, and second cups 184 are sized to receive portions of second drill pipe segments having a second diameter different than the first diameter.

In some embodiments of the modular carousel kit 150, the central support flange 156 may have a first set of bolt holes 186 to which components of both the first and second carousel assemblies 158, 160 may be attached. More specifically, the first carousel assembly 158 may include a first extension support flange 188 coupled to an upper end of a first extension support 190 that defines a second set of bolt holes 192, and a third set of bolt holes 194 may be formed through the first breaker plate 166. A first set of fasteners 196 may be configured to secure the first breaker plate 166 between the central support flange 156 and the first extension support flange 188. Still further, the second carousel assembly 160 may include a second extension support flange 198 coupled to an upper end of a second extension support 200 that defines a fourth set of bolt holes 202, and a fifth set of bolt holes 204 may be formed through the second breaker plate 178. A second set of fasteners 206 may be configured to secure the second breaker plate 178 between the central support flange 156 and the second extension support flange 198. In some embodiments, the first and second fasteners 196, 206 may have the same dimensions, in which case a single set of fasteners may be provided. Additionally, the upper flange 157 may be configured to receive each of the first top plate 162 and the second top plate 174.

INDUSTRIAL APPLICABILITY

The disclosed modular drill pipe carousel may be implemented into any drilling machine having a drill string made up of one or more drill pipe segments. The disclosed modular drill pipe carousel is intended to permit the carousel to be adapted for use with drill pipe segments having different lengths and/or diameters without requiring complete replacement of the carousel.

Figure 12:
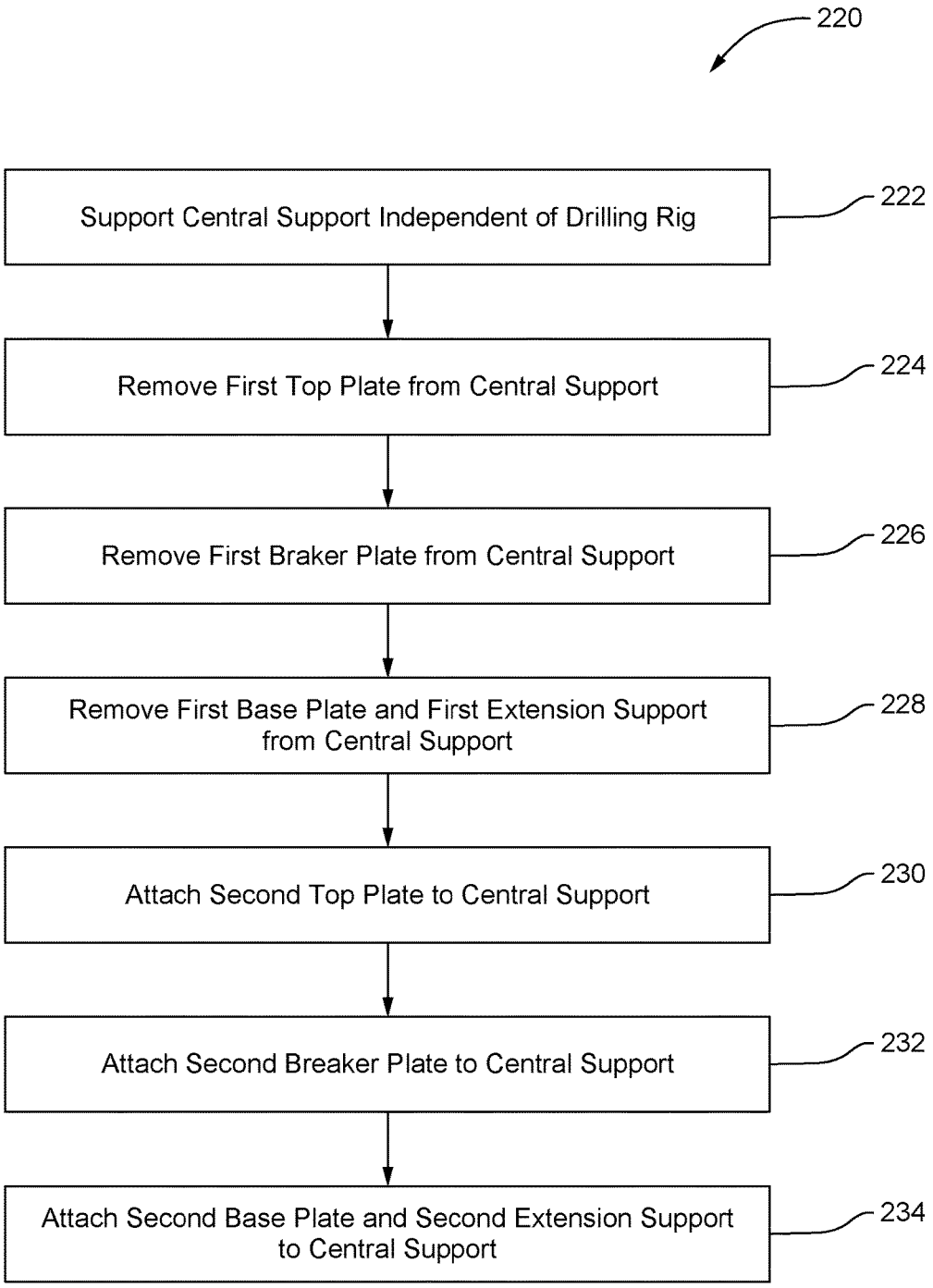
FIG. 12 is a block diagram schematically illustrating a method of reconfiguring a modular carousel.

For example, a block diagram provided at FIG. 12 illustrates a method 220 of reconfiguring a carousel for a drilling rig from a first configuration sized to hold a first drill pipe segment having a first diameter to a second configuration sized to hold a second drill pipe segment having a second diameter different from the first diameter. At block 222, the method 220 includes supporting a central support of the carousel independent of the drilling rig. At block 224, a first top plate, having a first top plate slots sized to receive an upper end portion of the first drill pipe segment, is removed from a top end of the central support. At block 226, a first breaker plate, having first a breaker plate slot sized to receive an intermediate portion of the first drill pipe segment, is removed from a bottom end of the central support by disassembling a first coupler assembly. At block 228, a first base plate, having a first cup sized to receive bottom end portions of the first drill pipe segment, and first extension support are removed from a bottom end of the central support.

Continuing at block 230, the method includes attaching a second top plate, having a second top plate slot sized to receive an upper end portion of the second drill pipe segment, to a top end of the central support. At block 232, a second breaker plate, a second breaker plate slot sized to receive an intermediate portion of the second drill pipe segment, to the bottom end of the central support by assembling a second coupler assembly. Finally, at block 234, a second base plate, having a second cup sized to receive a bottom end portion of the second drill pipe segment, and second extension support are attached to a bottom end of the central support.

In some embodiments of the method 220, a central support flange is coupled to the bottom end of the central support and a first extension support flange is coupled to an upper end of the first extension support, so that the first coupler assembly includes a first set of bolt holes in the central support flange, a second set of bolt holes in the first extension support flange, a third set of bolt holes in the first breaker plate, and a first set of fasteners configured to secure the first breaker plate between the central support flange and the first extension support flange. In this embodiment, disassembling the first coupler assembly includes removing the first set of fasteners from the first, second, and third sets of bolt holes. In a further refinement, a second extension support flange is coupled to an upper end of the second extension support, so that the second coupler assembly includes the first set of bolt holes in the central support flange, a fourth set of bolt holes in the second extension support flange, a fifth set of bolt holes in the second breaker plate, and a second set of fasteners configured to secure the second breaker plate between the central support flange and the second extension support flange. Accordingly, assembling the second coupler assembly includes securing the second set of fasteners through the first, second, and third sets of bolt holes.

Other embodiments of the method 220 may perform steps simultaneously by providing sub-assemblies of components. For example, the first breaker plate, first base plate, and first extension support may be integrally provided as a first base end sub-assembly configured to be attached as a first unit to the central support flange, while the second breaker plate, second base plate, and second extension support may be integrally provided as a second base end sub-assembly configured to be attached as a second unit to the central support flange. In this embodiment, removing the first base plate and the first extension support is performed simultaneously with removing the first breaker plate by removing the first base end sub-assembly from the central support, and attaching the second base plate and second extension support is performed simultaneously with attaching the second breaker plate by attaching the second base end sub-assembly to the central support.

In some applications, the method 220 may be further adapted to adjust for the length of the drilling pipe segment. For example, the central support may include an upper support segment defining the top end, a lower support segment defining a bottom end, and a joint configured to removably attach the upper support segment to the lower support segment, wherein the lower support segment has a first length. The method 220 may further include removing the upper support segment from the lower support segment and attaching a replacement upper support segment to the lower support segment, wherein the replacement upper support segment has a second length different than the first length.

In yet other applications, the method 220 may further include detachment/attachment of guides provided along the central support. For example, the method 220 may include removing a first upper guide, having a first upper guide slot sized to receive the first drill pipe segment, from the central support. A first lower guide, having a first lower guide slot sized to receive the first drill pipe segment, may also be removed from the central support. A second upper guide, having a second upper guide slot sized to receive the second drill pipe segment, may be attached to the central support. Finally, a second lower guide, having a second lower guide slot sized to receive the second drill pipe segment, may be attached to the central support.

It will be appreciated that the foregoing description provides examples of the disclosed assembly and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. A modular carousel for a drilling rig for holding a plurality of drill pipe segments, the modular carousel comprising:

a central support having a top end and a bottom end;

a top plate removably coupled to the top end of the central support, the top plate including a plurality of top plate slots sized to receive upper end portions of the drill pipe segments;

a breaker plate having a plurality of breaker plate slots sized to receive intermediate portions of the drill pipe segments, wherein each of the plurality of breaker plate slots includes diametrically opposed flats sized to engage complementary shaped flat sections of the drill pipe segments, and wherein a flat distance between the flats of the breaker plate slots and a flat section distance between the flat sections are less than an outer diameter of the plurality of drill pipe segments;

a coupler assembly configured to removably attach the breaker plate to the bottom end of the central support; and a base plate coupled to the breaker plate by an extension support, the base plate including a plurality of cups each sized to receive a bottom end portion of one of the plurality of drill pipe segments, wherein each of the plurality of cups is axially aligned with a corresponding one of the plurality of breaker plate slots.

2. The modular carousel of claim 1, in which the coupler assembly comprises a central support flange coupled to the bottom end of the central support and defining a first set of bolt holes, an extension support flange coupled to an upper end of the extension support and defining a second set of bolt holes, a third set of bolt holes formed through the breaker plate and aligned with the first and second sets of bolt holes, and a plurality of fasteners configured to secure the breaker plate between the central support flange and the extension support flange.

3. The modular carousel of claim 2, in which each of the first, second, and third sets of bolt holes has an identical bolt hole pattern, and in which the bolt hole pattern is configured such that the first, second, and third sets of bolt holes are axially aligned only when the bottom end of the central support, the extension support, and the breaker plate are rotationally positioned relative to each other so that the plurality of top plate slots, the plurality of breaker plate slots, and the plurality of cups are axially aligned.

4. The modular carousel of claim 3, in which the bolt hole pattern includes at least one oversized bolt hole having a larger diameter.

5. The modular carousel of claim 1, in which the breaker plate, base plate, and extension support are integrally provided as a base end sub-assembly configured to be attached as a unit to the bottom end of the central support.

6. The modular carousel of claim 1, in which the central support includes an upper support segment defining the top end, a lower support segment defining the bottom end, and a joint configured to removably attach the upper support segment to the lower support segment.

7. The modular carousel of claim 1, further including an upper guide removably coupled to the central support and defining a plurality of upper guide slots sized to receive the drill pipe segments, and a lower guide removably coupled to the central support and defining a plurality of lower guide slots sized to receive the drill pipe segments.

8. A modular carousel kit for use with a drilling rig, the modular carousel kit comprising:

a central support having a top end and a bottom end;

a central support flange coupled to the bottom end of the central support;

a first carousel assembly for holding a plurality of first drill pipe segments having a first diameter, the first carousel assembly including:

a first top plate configured for removable coupling to the top end of the central support, the first top plate including a plurality of first top plate slots sized to receive upper end portions of the first drill pipe segments;

a first breaker plate configured for removable coupling to the central support flange, the first breaker plate having a plurality of first breaker plate slots sized to receive intermediate portions of the first drill pipe segments, wherein each of the plurality of first breaker plate slots includes diametrically opposed first flats sized to engage complementary shaped first flat sections of the first drill pipe segments, and wherein a first flat distance between the first flats of the first breaker plate slots and a first flat section distance between the flat sections are less than the first diameter of the plurality of first drill pipe segments; and a first base plate coupled to the first breaker plate by a first extension support, the first base plate including a plurality of first cups each sized to receive a bottom end portion of one of the plurality of first drill pipe segments, wherein each of the plurality of first cups is axially aligned with a corresponding one of the plurality of first breaker plate slots; and a second carousel assembly for holding a plurality of second drill pipe segments having a second diameter different than the first diameter of the first drill pipe segment, the second carousel assembly including:

a second top plate configured for removable coupling to the top end of the central support, the second top plate including a plurality of second top plate slots sized to receive upper end portions of the second drill pipe segments;

a second breaker plate configured for removable coupling to the central support flange, the second breaker plate having a plurality of second breaker plate slots sized to receive an intermediate portion of the second drill pipe segments, wherein each of the plurality of second breaker plate slots includes diametrically opposed second flats sized to engage complementary shaped second flat sections of the second drill pipe segments, and wherein a second flat distance between the second flats of the second breaker plate slots and a second flat section distance between the second flat sections are less than the second diameter of the plurality of second drill pipe segments; and a second base plate coupled to the second breaker plate by a second extension support, the second base plate including a plurality of second cups sized to receive a bottom end portion of one of the second drill pipe segments, wherein each of the plurality of second cups is axially aligned with a corresponding one of the plurality of second breaker plate slots.

9. The modular carousel kit of claim 8, in which:

the central support flange defines a first set of bolt holes;

the first carousel assembly further includes a first extension support flange coupled to an upper end of the first extension support and defining a second set of bolt holes, a third set of bolt holes formed through the first breaker plate and aligned with the first and second sets of bolt holes, and a first set of fasteners configured to secure the first breaker plate between the central support flange and the first extension support flange; and the second carousel assembly further includes a second extension support flange coupled to an upper end of the second extension support and defining a fourth set of bolt holes, a fifth set of bolt holes formed through the second breaker plate and aligned with the first and fourth sets of bolt holes, and a second set of fasteners configured to secure the second breaker plate between the central support flange and the second extension support flange.

10. The modular carousel kit of claim 9, in which each of the first, second, third, fourth, and fifth sets of bolt holes has an identical bolt hole pattern, and in which the bolt hole pattern is configured such that the first, second, and third sets of bolt holes are axially aligned only when the bottom end of the central support, the first extension support, and the first breaker plate are rotationally positioned relative to each other so that the plurality of top plate slots, the plurality of first breaker plate slots, and the plurality of first cups are axially aligned, and the first, fourth, and fifth sets of bolt holes are axially aligned only when the bottom end of the central support, the second extension support, and the second breaker plate are rotationally positioned relative to each other so that the plurality of top plate slots, the plurality of second breaker plate slots, and the plurality of second cups are axially aligned.

11. The modular carousel kit of claim 10, in which the bolt hole pattern includes at least one oversized bolt hole having a larger diameter.

12. The modular carousel kit of claim 8, in which the first breaker plate, first base plate, and first extension support are integrally provided as a first base end sub-assembly configured to be attached as a first unit to the central support flange, and in which the second breaker plate, second base plate, and second extension support are integrally provided as a second base end sub-assembly configured to be attached as a second unit to the central support flange.

13. The modular carousel kit of claim 8, in which the central support includes an upper support segment defining the top end, a lower support segment defining the bottom end, and a joint configured to removably attach the upper support segment to the lower support segment.

14. The modular carousel kit of claim 8, in which:

the first carousel assembly further includes a first upper guide removably coupled to the central support and defining a plurality of first upper guide slots sized to receive the first drill pipe segments, and a first lower guide removably coupled to the central support and defining a plurality of first lower guide slots sized to receive the first drill pipe segments; and the second carousel assembly further includes a second upper guide removably coupled to the central support and defining a plurality of second upper guide slot sized to receive the second drill pipe segments, and a second lower guide removably coupled to the central support and defining a plurality of second lower guide slots sized to receive the second drill pipe segments.

15. A method of reconfiguring a carousel for a drilling rig from a first configuration sized to hold a plurality of first drill pipe segments having a first diameter to a second configuration sized to hold a plurality of second drill pipe segments having a second diameter different from the first diameter, the method comprising:

supporting a central support of the carousel independent of the drilling rig;

removing a first top plate from a top end of the central support, the first top plate including a plurality of first top plate slots sized to receive upper end portions of the first drill pipe segments;

removing a first breaker plate from a bottom end of the central support by disassembling a first coupler assembly, the first breaker plate including a plurality of first breaker plate slots sized to receive intermediate portions of the first drill pipe segments, wherein each of the plurality of first breaker plate slots includes diametrically opposed first flats sized to engage complementary shaped first flat sections of the first drill pipe segments, and wherein a first flat distance between the first flats of the first breaker plate slots and a first flat section distance between the flat sections are less than the first diameter of the plurality of first drill pipe segments;

removing a first base plate and first extension support from a bottom end of the central support, the first base plate including a plurality of first cups sized to receive a bottom end portion of one of the plurality of first drill pipe segments, wherein each of the plurality of first cups is axially aligned with a corresponding one of the plurality of first breaker plate slots;

attaching a second top plate to a top end of the central support, the second top plate including a plurality of second top plate slots sized to receive upper end portions of the second drill pipe segments;

attaching a second breaker plate to the bottom end of the central support by assembling a second coupler assembly, the second breaker plate including a plurality of second breaker plate slots sized to receive an intermediate portion of the second drill pipe segments, wherein each of the plurality of second breaker plate slots includes diametrically opposed second flats sized to engage complementary shaped second flat sections of the second drill pipe segments, and wherein a second flat distance between the second flats of the second breaker plate slots and a second flat section distance between the second flat sections are less than the second diameter of the plurality of second drill pipe segments; and attaching a second base plate and second extension support to a bottom end of the central support, the second base plate including a plurality of second cups sized to receive a bottom end portion of one of the second drill pipe segments, wherein each of the plurality of second cups is axially aligned with a corresponding one of the plurality of second breaker plate slots.

16. The method of claim 15, in which:

a central support flange is coupled to the bottom end of the central support;

a first extension support flange is coupled to an upper end of the first extension support;

the first coupler assembly includes a first set of bolt holes in the central support flange, a second set of bolt holes in the first extension support flange, a third set of bolt holes in the first breaker plate, and a first set of fasteners configured to secure the first breaker plate between the central support flange and the first extension support flange; and disassembling the first coupler assembly includes removing the first set of fasteners from the first, second, and third sets of bolt holes.

17. The method of claim 16, in which:

a second extension support flange is coupled to an upper end of the second extension support;

the second coupler assembly includes the first set of bolt holes in the central support flange, a fourth set of bolt holes in the second extension support flange, a fifth set of bolt holes in the second breaker plate, and a second set of fasteners configured to secure the second breaker plate between the central support flange and the second extension support flange; and assembling the second coupler assembly includes securing the second set of fasteners through the first, fourth, and fifth sets of bolt holes.

18. The method of claim 17, in which:

the first breaker plate, first base plate, and first extension support are integrally provided as a first base end sub-assembly configured to be attached as a first unit to the central support flange;

the second breaker plate, second base plate, and second extension support are integrally provided as a second base end sub-assembly configured to be attached as a second unit to the central support flange;

removing the first base plate and first extension support is performed simultaneously with removing the first breaker plate by removing the first base end sub-assembly from the central support flange; and attaching the second base plate and second extension support is performed simultaneously with attaching the second breaker plate by attaching the second base end sub-assembly to the central support flange.

19. The method of claim 15, in which:

the central support includes an upper support segment defining the top end, a lower support segment defining the bottom end, and a joint configured to removably attach the upper support segment to the lower support segment, the upper support segment having a first length; and the method further includes removing the upper support segment from the lower support segment and attaching a replacement upper support segment to the lower support segment, the replacement upper support segment having a second length different than the first length.

20. The method of claim 15, further comprising:

removing a first upper guide from the central support, the first upper guide defining a plurality of first upper guide slots sized to receive the first drill pipe segments;

removing a first lower guide from the central support, the first lower guide defining a plurality of first lower guide slot sized to receive the first drill pipe segments;

attaching a second upper guide to the central support, the second upper guide defining plurality of a second upper guide slot sized to receive the second drill pipe segments; and attaching a second lower guide to the central support, the second lower guide defining plurality of a second lower guide slot sized to receive the second drill pipe segments.

* * * * *